US005152083A

United States Patent [19]

Gagne

[11] Patent Number: 5,152,083

[45] Date of Patent: Oct. 6, 1992

[54] AIR PUMPING ASSEMBLY FOR AN ICE SKATE PRESSURIZED BOOT

[75] Inventor: Francois Gagne, Montreal, Canada

[73] Assignee: A. Lambert International Inc., Montreal, Canada

[21] Appl. No.: 653,927

[22] Filed: Feb. 12, 1991

[51] Int. Cl.[5] ..... A43B 5/16

[52] U.S. Cl. ..... 36/115; 36/88; 36/93; 36/71

[58] Field of Search ..... 36/88, 93, 89, 91, 92, 36/115, 137, 139, 119, 71; 417/472, 437

[56] References Cited

U.S. PATENT DOCUMENTS

| | | | |
|---|---|---|---|
| 2,276,502 | 3/1942 | McCoy | 277/42 |
| 3,664,043 | 5/1972 | Polumbus, Jr. | 36/71 |
| 4,232,459 | 11/1980 | Vaccari | 36/71 |
| 4,702,022 | 10/1987 | Porcher | 36/119 |
| 4,730,403 | 3/1988 | Walkhoff | 36/119 |
| 4,732,549 | 3/1988 | von Schuckmann | 417/472 |
| 4,845,862 | 7/1989 | Phillips, Jr. et al. | 36/83 |
| 4,893,417 | 1/1990 | Dalla Lana | 36/10 |

FOREIGN PATENT DOCUMENTS

| | | | |
|---|---|---|---|
| 2456612 | 6/1975 | Fed. Rep. of Germany | 36/71 |
| 3326250 | 1/1985 | Fed. Rep. of Germany | 417/472 |
| 3427644 | 1/1986 | Fed. Rep. of Germany | 36/119 |
| 2496423 | 6/1982 | France | 36/117 |

*Primary Examiner*—Jimmy G. Foster
*Assistant Examiner*—Thomas P. Hilliard
*Attorney, Agent, or Firm*—Edwin E. Greigg; Ronald E. Greigg

[57] ABSTRACT

An air pump assembly is disclosed which comprises an outer shell and an inner shell nested within the outer shell; the shells defining between them a housing into which is secured an air pump. The latter includes an air chamber having a solid base and a resilient pumping membrane; the pump further including valving unit in air communication with the air chamber, the unit being provided with an air deflation rod. The housing has an aperture capable of giving access to the flexible membrane to operate the pump. This housing is sized so that the air pump is held completely in it to protect it against outer shocks; the membrane being accessible from outside the outer shell through the aperture. The same outer shell is formed with an outwardly open recess into which the deflation rod is received; this recess being sized for the rod to be held wholly in it and be protected against outer shocks.

14 Claims, 4 Drawing Sheets

AIR PUMPING ASSEMBLY FOR AN ICE SKATE PRESSURIZED BOOT

BACKGROUND OF THE INVENTION

1. Field of the Invention

This invention relates to an air pump assembly adapted for mounting on the boot of an air-pressurized ice-skate, and to such an assembly in combination with an air-pressurized ice-skate.

2. Description of the Prior Art

An air pump assembly of the above type is already known and is used for mounting on the rigid outer shell of an air-pressurized ski-boot, as disclosed in U.S. Pat. No. 4,730,403 of Mar. 15, 1988. In that patent, the air pump itself, which feeds air into an air bladder mounted between the outer shell and the cushioning inner material of the boot, has an operating pump flap or push button and a deflation rod both of which protrude from the pump body as well as from the boot outer shell. They are therefore easily accessible for finger actuation but, by the same token, can accidentally be operated if the boot hits obstacles during skiing. This is of course not likely to happen and it may be said that a ski boot so equipped is safe in this respect. This would however not be the case if an airpump assembly of this type was to be mounted on the boot of an ice-skate when used for playing hockey. The pump flap or membrane and the deflation rod would then be subject to untimely operation due to outside shocks resulting from flying pucks, hockey sticks or even the blades of another player's ice-skate.

SUMMARY OF THE INVENTION

It is therefore an object of the present invention to provide an air-pump assembly of the above type where the pump flap or flexible membrane and the deflation rod are completely sheltered from outside, yet are available for finger actuation.

More specifically, the invention provides an air-pumping assembly comprising: an air pump which includes a body having a rigid base and a pumping membrane solid with and movable relative to the base to define an air chamber; the pump further including a valving unit in operative air communication with the chamber; this unit including an outwardly projecting deflation rod; the pumping assembly further has a first and a second shell nested within the first shell and which, in combination, define a pump housing in which the pump is mounted, this housing having an aperture capable of giving access to the pumping membrane for operating the pump. The pump is mounted within the housing which is sized so that the said pump is held completely in it so as to be protected against outside shocks while the aperture is likewise suitably sized so that the membrane is accessible for operation from outside the first shell. According to the invention, the flexible shell is also formed with an outwardly open recess into which the deflation rod is received, this recess being sized so that the rod is held completely in it to be protected against outside shocks while being accessible from outside the first shell for actuation.

The assembly described above may advantageously include a third shell nesting into the second shell, the three shells being secured together.

The invention also applies to such an assembly when in combination with an ice-skate comprising a boot having a rigid outer shell including a back section and an inflatable air bladder, in the shell; this bladder having an air inlet pipe connected to an air inflation pipe of the pump; stitching means securing the boot back section and a stitching flange of the third shell together.

Good nesting can be achieved by having the three shells appropriately arcuately bent about their vertical and horizontal axes.

Further objects and advantages of the invention will appear from the description that follows of a preferred embodiment having reference to the appended drawings.

DESCRIPTION OF THE PREFERRED EMBODIMENT

Figure 1:
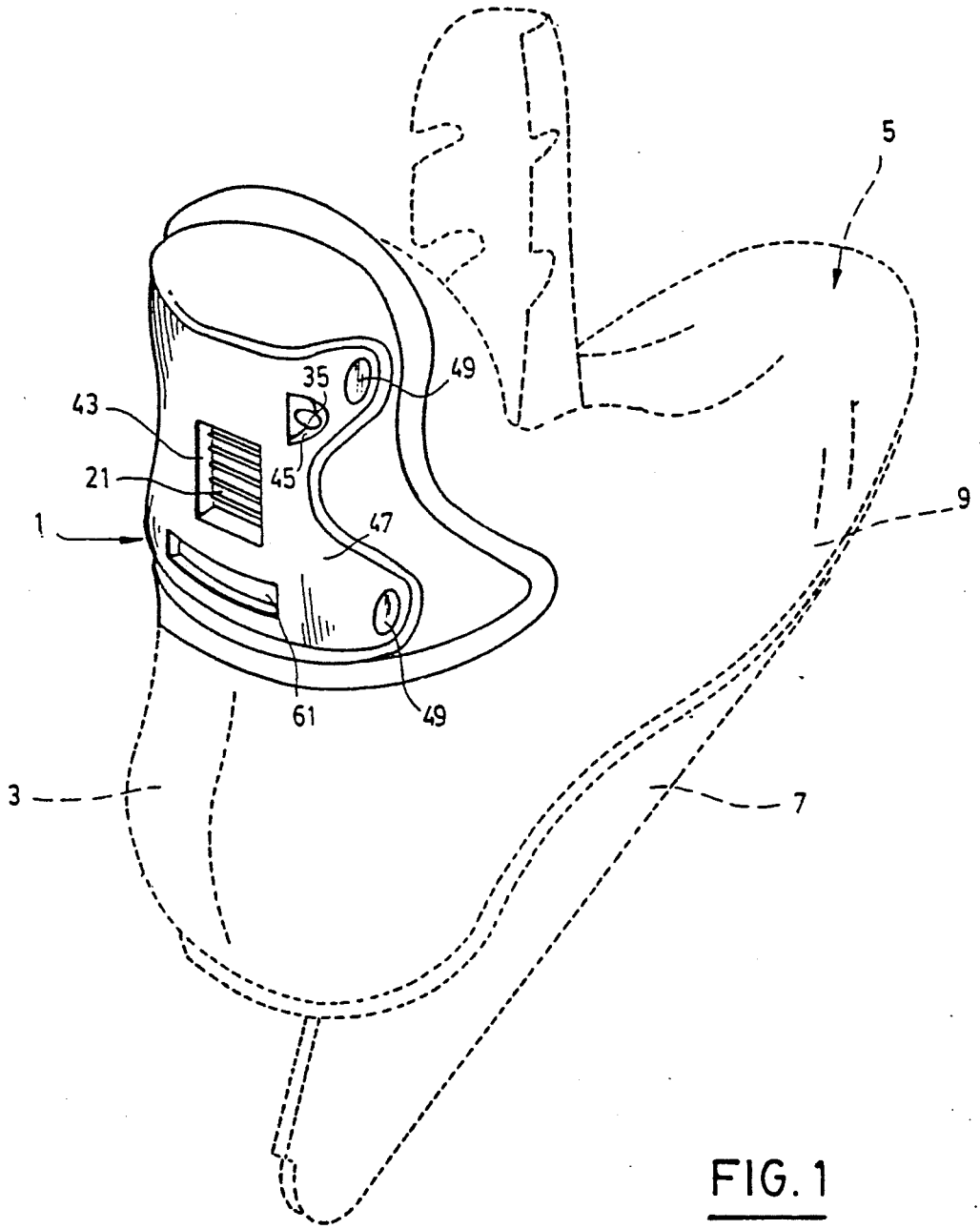
FIG. 1 is a diagrammatic perspective view of a known ice-skate provided with an air-pump assembly according to the invention.
Figure 2:
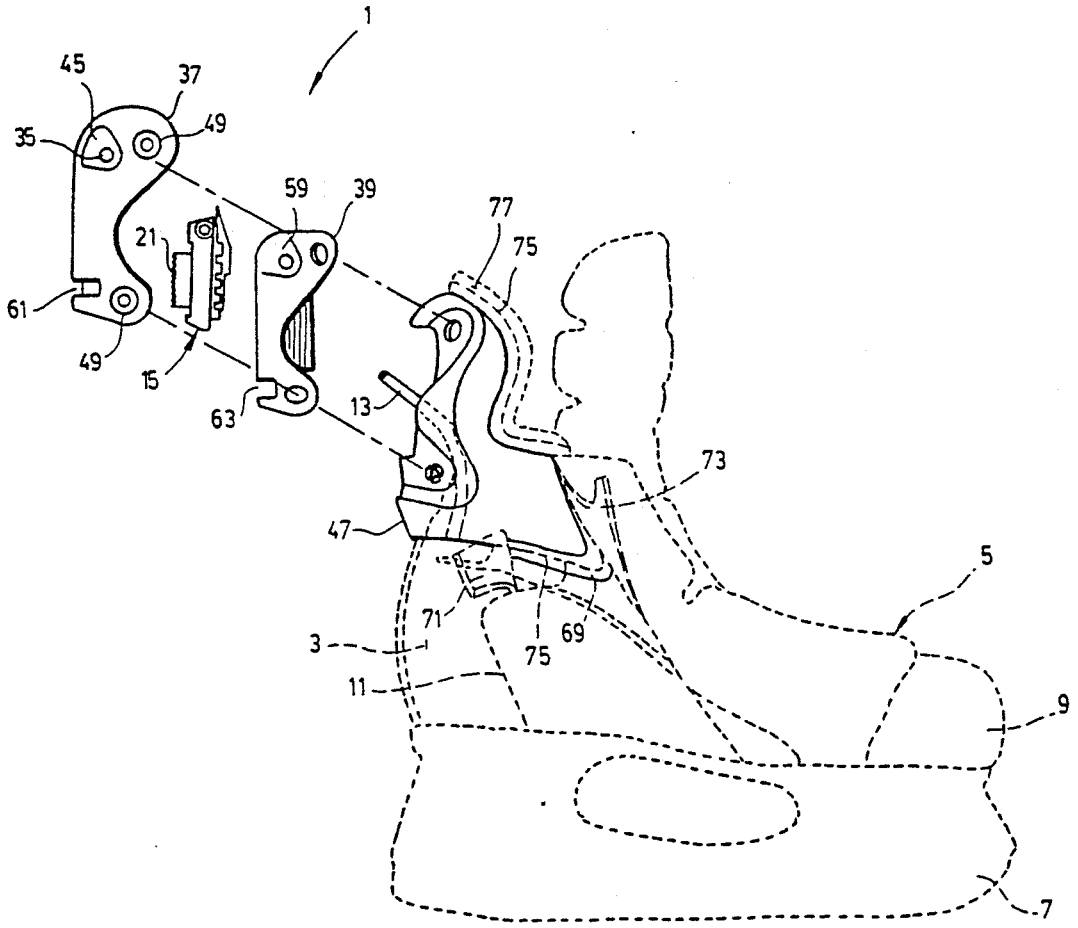
FIG. 2 being a diagrammatic exploded side view of the same.

The air-pumping assembly 1 is shown to be mounted, in FIGS. 1 and 2, on the back section 3 of a conventional ice-skate 5 in which the skating blade 7 is fixed to the boot 9. The latter has, between its stiff outer shell and its cushioning inner material, an inflatable air bladder 11 which serves, as is known, to provide a better and more comfortable grip of the wearer's foot. Connected to the bladder 11 is a flexible air conducting pipe 13 extending out of the boot 9, at its back.

The assembly 1 itself is seen to comprise an air pump 15 of known type and essentially the same as the air pump disclosed in the above-mentioned U.S. patent. Its body defines an air chamber 17 (FIG. 4), having a rigid base 19 and a pumping membrane 20 movable relative to the base 19, being composed of a hard flat push button 21 having a circumscribing resilient skirt 23 merging, at its free end, into a rigid lobe 25 air-tightly press-fitted into an appropriate niche 27 provided in the base 19. An air-outlet conduit 29 leads the air out of the chamber. As gathered, depression of the push button 21 sends air out of the chamber 17 through the conduit 29. A check-valve (not shown) allows air to be sucked into the chamber 17 upon release of the push button 21. The air-pump 15 further includes a valving unit 31 to which the conduit 29 is connected. Leading out of the unit 31 is a hard pipe 33 over the outwardly ribbed end of which the end of the bladder flexible air pipe 13 is mounted.

The valve unit 31 includes, in known manner and somewhat like the valve unit of a common tire air-chamber, a valve sleeve into which a valve head is movable between an open position when the membrane push button 21 is depressed to allow air into the bladder 11 through the air pipes 33 and 13, and a close position under a spring bias applied on the stem of the valve head when the push button 21 is released. Additionally, the valving unit 31 includes an axially displaceable deflation rod 35 coaxial with the valve-head stem and operable from outside the valve sleeve to contact and move the valve-head stem and valve head to open position against the stem bias, when it is desired to evacuate the air bladder through an appropriate bleeding arrangement of the valving unit.

Figure 4:
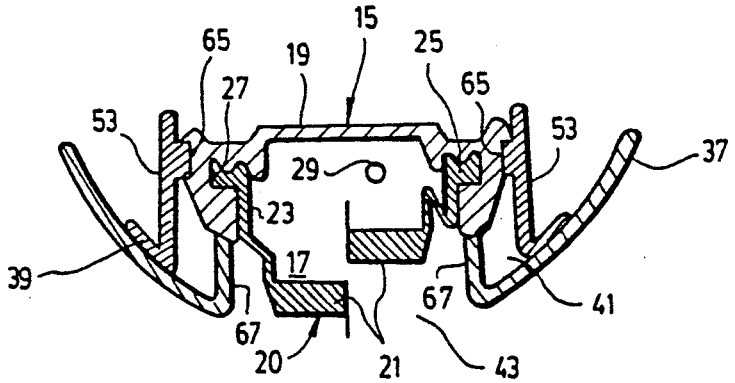
Figure 5:
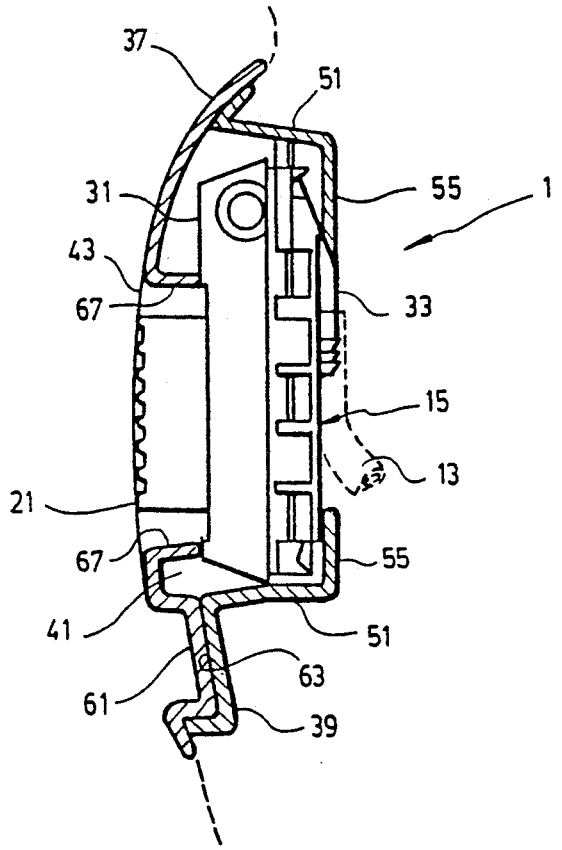
Figure 6:
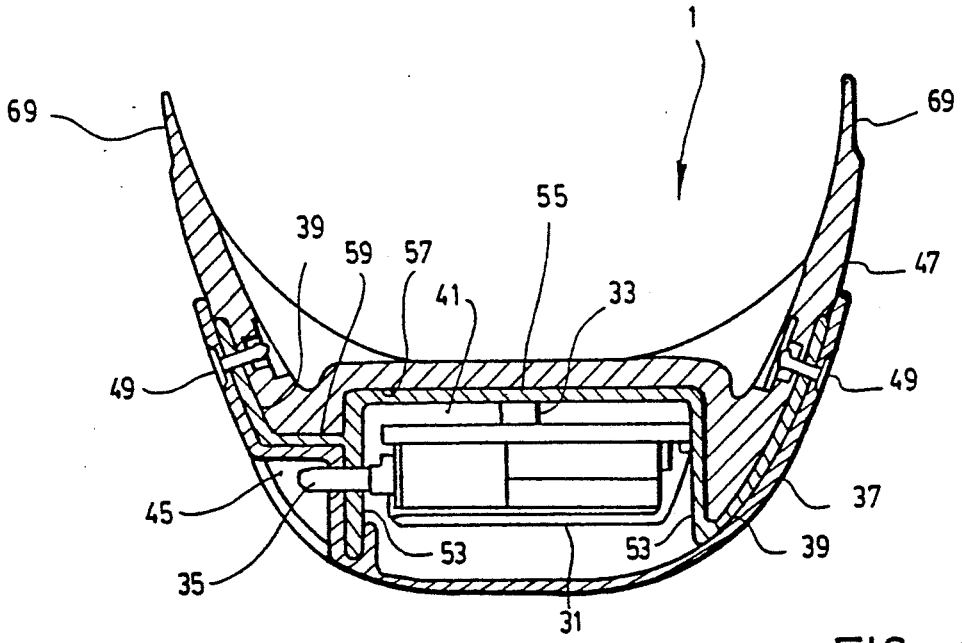

The air-pumping assembly 1 also comprises a first shell 37 into which nests a second shell 39, both being advantageously slightly concave about their vertical and horizontal axes as seen in FIGS. 4, 5 and 6. They define between them a pump housing 41 having an aperture 43 capable of giving access to the push button 21 for operating the pump which is fixed to the pump body in a manner described hereinbelow.

According to the invention, the size of the housing 41 is sufficient so that the air pump 15 is held wholly in it, protectively against outside shocks, as best appreciated in FIGS. 1 and 5; the membrane push button 21 being then of course accessible from outside the first shell 37 through the aperture 43. For this purpose, the operative portion of the pump membrane 20, that is the push button 21, stands flush with the outer surface of the first shell 37, as in FIG. 5. It is recommended however, for greater protection, that it stand inwardly of the pump housing 41 short of the aperture 43, as appreciated from FIG. 1.

Again in accordance with the invention, the first shell 37 bends inward to form an angle defining an outwardly open nook or recess 45 (FIGS. 1, 6) into which the deflation rod 35 extends. Again and somewhat like the housing 41, the size of the recess 45 is sufficient so that the rod 35 is completely received in it, protectively against outside shocks or blows from a flying puck, a hockey stick or the skating blade of another player, as aforesaid.

For a stronger construction and also for aesthetic reasons, it is recommended that the two concave shells 37 and 39, with the pump 15 secured in the housing 41, be fitted over an outwardly convex third shell 47 and the three shells secured together by medical-type rivets 49, as in FIG. 6. These rivets are well known and include an outer disk-like head that should be enclosed in appropriate recesses of the first shell 37, flush with its outer surface.

The third shell could be made, for instance, of hard foam material coated with a layer of fabric material on its side facing the second shell 39. As to the first and second shells 37, 39, they could be made of hard nylon.

As shown, the second shell 39 has straight pump brackets 51, 53, essentially parallel in pairs and directed away from the first shell 37 around the housing aperture 43. These brackets 51, 53, are further turned toward one another at their ends away from the aperture 43 to form a bottom support 55 for the air pump 15. The support 55 is apertured to allow exit of the pump outlet pipe 33 (FIG. 5). The brackets 51, 53, the bottom support 55 and the first shell 37 around the aperture 43 define together the housing 41 for the pump 15. The third shell 47, on the other hand, is recessed at 57 (FIG. 6) to receive the bottom support 55. Also, the outer face of the second shell 39 is turned in at 59 into a flange joining an adjacent one of the pump brackets 53 to form an angle into which lodges the angle of the first shell 37 defining the nook or recess 45. One side of each of the angles has appropriate holes through which the deflation rod 35 may slide.

Figure 3:
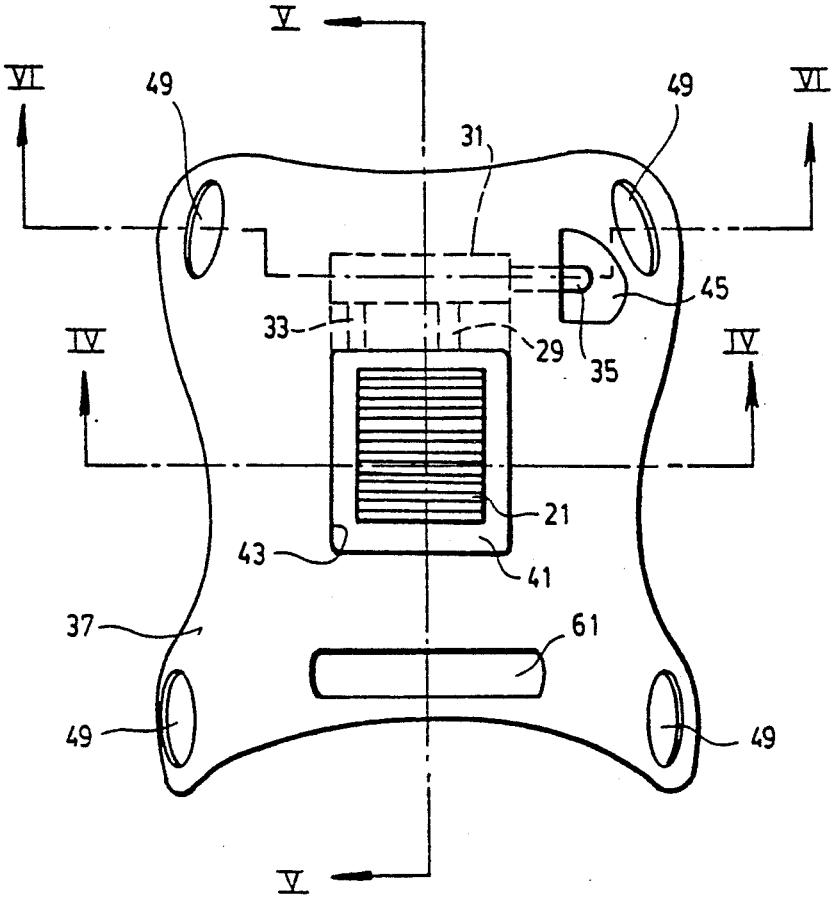
FIG. 3 is a diagrammatic elevation view of the air-pump assembly and FIGS. 4 to 6, cross-sectional views respectively along lines IV—IV, V—V, and VI—VI of FIG. 3; FIG. IV further including a third shell.

With reference to FIGS. 1, 3 and 5, it is seen that the bottom part of the outer first shell 37 is bent inward to form a boss 61 snapped into a companion groove 63 of the second shell 39 to help in positioning the two shells.

FIG. 4 shows that the pump 15 is secured on the second shell 39 by means of a tongue-and-groove connection 65 between the pump base 19 and the pump brackets 53.

For a steadier hold of the pump 15 within the housing 41, the first shell 37 has inwardly turned shoulders 67, around the aperture 43, which butt against the hard base 19.

Finally, the inward end of the third shell 47 is formed with a circumscribing stitching flange 69. Referring to FIG. 2, portions of the leather strips forming the boot back section 3 have been turned out into flaps 71, 73, to show how the lower portion of the flange 69 is fixed to the boot by stitching 75. The upper portion of the flange 69 is, however, tucked beneath the rolled over edge 77 of the upper end of the boot back section.

I claim:

1. A pumping assembly comprising:

an air pump including a body having a base and a pumping membrane solid with and movable relative to said base to define an air chamber, said air pump further including a valving unit in operative air communication with said chamber, said valving unit including an outwardly projecting air deflation rod;

a first shell and a second shell nested within said first shell, said first and second shells defining therebetween a housing sized to receive said air pump and provided with an aperture formed through said first shell to five access to said pumping membrane for operating said pump;

said housing being sized so that said air pump is held completely therein, said aperture being sized so that said membrane is accessible for operation from outside said first shell;

said first shell having shoulders around said aperture turned inwardly into said housing and butting against said base of said air pump body to hold said air pump into said housing;

said first shell being formed with an outwardly open recess into which said deflation rod is received, said recess being sized so that said rod is held completely therein while being accessible from outside said first shell for actuation;

said second shell has parallel brackets directed away from said first shell beyond said shoulders with respect to said aperture;

said brackets are turned toward one another at their ends away from said aperture to form a bottom support for said air pump; said brackets, said bottom support and said first shell around said aperture defining said pump housing;

said pump is fixed to said second shell by a tongue-and-groove connection between said pump rigid base and said brackets, respectively;

a third shell nesting into said second shell, and means securing said first, second, and third shells together.

2. A pumping assembly as claimed in claim 1, wherein said first, second and third shells are concave.

3. A pumping assembly as claimed in claim 1, wherein said third shell is molded in foam material.

4. A pumping assembly as claimed in claim 3, wherein said foam material is coated with a layer of fabric material on a side thereof facing said second shell.

5. A pumping assembly as claimed in claim 4, wherein said first, second and third shells are concave.

6. A pumping assembly as claimed in claim 4, wherein said first and second shells are made of hard nylon.

7. A pumping assembly as claimed in claim 1, wherein said pumping membrane has an operative portion flush with an outer surface of said first shell, in relaxed condition of said membrane.

8. A pumping assembly as claimed in claim 1, wherein said pumping membrane has an operative portion standing short of said housing aperture, in relaxed condition of said membrane.

9. A pumping assembly as claimed in claim 1, wherein said first and second shells are concave.

10. A pumping assembly as claimed in claim 1, wherein:

said air pump includes an air inflation pipe that leads out of said valving unit, said third shell has a circumscribing stitching flange; and said assembly is mounted onto an ice skate comprising a boot having an outer shell including a back portion and an inflatable air bladder; said bladder having an air inlet pipe connected to said air inflation pipe, and stitching means securing said stitching flange and said boot back portion together.

11. A pumping assembly as claimed in claim 10, wherein said first, second, and third shells are concave.

12. A pumping assembly as claimed in claim 11, wherein:

said air pump is fixed to said second shell; and said housing aperture is formed through said first shell.

13. A pumping assembly as claimed in claim 10, wherein said pumping membrane has an operative portion flush with the outer surface of said first shell, in relaxed condition of said membrane.

14. A pumping assembly as claimed in claim 10, wherein said pumping membrane has an operative portion standing short of said housing aperture, in relaxed condition of said membrane.

* * * * *